US005090785A

United States Patent [19]

Stamp

[11] Patent Number: 5,090,785

[45] Date of Patent: Feb. 25, 1992

[54] MULTI-COMPARTMENT CONTAINER

[76] Inventor: John R. Stamp, 24 Clovelly Drive, Saint John, New Brunswick, Canada, E2K 4L7

[21] Appl. No.: 560,570

[22] Filed: Jul. 31, 1990

[51] Int. Cl.[5] ..... A47B 41/04

[52] U.S. Cl. ..... 312/319; 312/290; 312/328; 220/908; 220/404

[58] Field of Search ..... 220/908, 909, 263, 404; 312/321.5, 328, 319, 290

[56] References Cited

U.S. PATENT DOCUMENTS

| | | | |
|---|---|---|---|
| 1,949,508 | 3/1934 | Woodall | 312/290 |
| 2,895,782 | 7/1959 | Fragale | 220/909 X |
| 4,189,195 | 2/1980 | Turney et al. | 312/321.5 |
| 4,285,964 | 11/1988 | Miller et al. | 220/908 X |
| 4,577,778 | 3/1986 | Kim | 220/404 X |
| 4,765,579 | 8/1988 | Robbins et al. | 220/908 |
| 4,834,262 | 5/1989 | Reed | 220/909 X |
| 4,892,218 | 1/1990 | Reiling | 220/263 |

*Primary Examiner*—Joseph Falk
*Attorney, Agent, or Firm*—Whitham & Marhoefer

[57] ABSTRACT

A compartmentalized container of rectangular-like shape consisting of a lower and upper portion each of which contains at least one compartment for receiving material such as refuse. The upper and lower compartments are accessed by operation of pedals operating on the top lid of the container and the lower front panel of the container respectively. This allows hands-free use of all the compartments for segregating refuse into reusable or recyclable components, such as bottles, papers, or cans. The container is designed to use surplus grocery and shopping bags in addition to normal garbage bags in the containment and disposal process.

14 Claims, 7 Drawing Sheets

MULTI-COMPARTMENT CONTAINER

This invention relates to a multi-compartmented container for the storage of sundry items or bulk material and is particularly directed to such a container which is useful for collecting refuse of diverse character.

BACKGROUND

There is a need for the householder to participate in society's ever-increasing demand to reuse and recycle refuse. There is also a need for an economical, efficient and practical compartmentalized refuse container. It is furthermore recognized that bags or liners are desirable for use with refuse disposal. Indeed, an entire industry is predicated on the need for garbage bags.

As most householders regularly experience a surplus supply of plastic or paper grocery bags subsequent to their normal purchase of groceries the use of these bags in place of garbage bags manufactured specifically for the purpose of lining and containing refuse represents a considerable reduction in the need for these garbage bags, and savings for the householder.

A refuse container which combines refuse segregation with use of paper or plastic grocery bags and overcomes the problems associated with the smaller nominal volume of the grocery bag and the need for more frequent bag/liner changes and which may also function with industry manufactured garbage bags when grocery bags are unavailable is desirable. The prior art does not demonstrate these combined capabilities.

Multi-compartmented refuse receptacle are found, for example, in U.S. Pat. Nos. 4,834,253 of May 30, 1989; 4,867,328 of Sept. 19, 1989; and 4,893,719 and 4,893,722 both of Jan. 16, 1990. None of these patents satisfies the requirements stipulated above.

SUMMARY OF THE INVENTION

Generally speaking, the present invention provides a multi-compartmented container comprising: a) a housing defined by side, rear, bottom and upper front walls; b) a lower front wall pivotally attached to one of a side wall or the bottom wall; c) a top wall pivotally attached to the rear wall; d) first means defining at least one first compartment in an upper portion of the container; e) second means defining at least one second compartment connected to the lower front wall; f) first pivot means operable by a user to open the top wall so as to provide access to the at least one first compartment; and g) second pivot means operable by a user to pivot the lower front wall so as to provide access to the at least one second compartment.

It is evident that most kitchens have limited floor space for refuse containers; that such floor space will be limited by cabinetry, walls and appliances; and that a refuse container higher than about kitchen counter height will seem obtrusive. The main housing of this invention fits neatly into that practical space.

The compartments in the housing, upper and lower, conform to dimensions similar to those of paper and plastic grocery bags, thus facilitating the use of these grocery bags by the user as refuse holders and liners.

The grocery bags, i.e., the plastic bags are held by frame-type holders and the paper bags may be contained within bins. This permits the swift and efficient changing of the bags. This also permits the use of bags with a range of opening circumferences, so that most types of grocery bags and even regular garbage bags may be used. Furthermore, specialized containers, such as sealable holding units, could be used in such bins, if the container of the invention were to be used in, for example, hospitals for the storage or disposal of needles, contaminated or dangerous waste. The known prior art, where plastic liners are employed, uses liners which must have specific dimensions to fit snugly around the mouths of containers or holders.

Grocery bag dispensers may be incorporated into the top or front of the container, or separately mounted nearby.

Known prior art receptacles which may use garbage bags or paper or plastic grocery bags are limited in the height they can utilize by the height of the bags. Given the same kitchen floor area, they can at best utilize half the volume which this invention does. The only option of the known prior art is to extend upward, thus creating the need for specialized bags/liners which would be of awkward proportions. An exception to this in the prior art is Jones U.S. Pat. No. 4,893,722. However that invention is limited in the size of refuse deliverable to the bottom containers and performs that function in a different, less efficient way.

The efficient householder seeks to dispose of several items at a time when possible, and the need to direct these items into different compartments shows the householder having his/her hands full. Thus the provision of hands-free access to the compartments becomes all the more desirable.

The top is operated by a foot pedal, which allows the user to open the top temporarily with a light touch, to keep it open at a convenient angle by employing full pedal travel, i.e., the top remains open with the foot removed from the pedal, or to use the pedal to swing the top completely out of the way of the top of the container opening. The pedal also controls the closing of the top in the first two of the three aforementioned modes, i.e., in the first of the three by releasing the pressure and in the second of the three by applying a slight upward lift to the pedal.

Pedal actuation of the lower front wall swings out the bag/bin holding assembly which is housed inside the lower portion of the container and fixed to the inside of the lower front wall. The degree of pressure used may be slight, exposing a part of the bag/bin assembly if desired, and upon release of such pressure the assembly returns to its housing under force of gravity.

The user may also apply more pressure to as to swing the center of gravity of the assembly over the pivot point exposing the entire assembly. The travel of the assembly is arrested by contact of the pedal with the floor or a suitable lug on the front of the container. Return of the assembly to the housing is easily accomplished by applying upward pressure to the underside of the pedal.

Thus by pedal action alone degrees of convenient hands-free access to all refuse compartments is accomplished. The user can keep the heel of the foot on the floor at all times and maintain balance. The pedals for upper and lower portions may be used separately or in concert.

The user also has the option of opening the top by hand when the item or items being disposed can be held by the other hand. This is easily accomplished because the top is near kitchen counter height and the top moves easily due to absence of linkage to its operating mechanism.

With a bottom hinged lower front wall there is a transverse gap between the top of the lower front wall and the bottom of the upper front wall, to permit outwards movement of the compartments mounted to that wall. The gap is closed by a flexible gap sealer. Removal of the gap sealer, or an alternate embodiment of it such as plastic or rubber hanging strips, enables the user to dispose of most items, such as cans or bottles, by directly dropping them through the gap. Thus there is a whole spectrum of convenience for disposal, from large loads, large objects to small loads, small objects, for the user to employ.

The invention provides savings through the use of surplus grocery/shopping bags which enables the user to recoup the purchase price of the invention. The invention also provides ready availability of an unused compartment when the one being used becomes full. The practical design and the ease with which the bags/bins are emptied and/or replaced make this invention desirable as a regular refuse container and it provides a means for householders living in areas where official recycling efforts are not in practice to purchase a refuse container to be used as a regular refuse container yet perform as a recycling refuse container when their areas "go green". Of course, the invention need not be used for refuse per se. Bulk material such as flour or sugar could be stored in suitable bins or other items could be contained within suitably designed bin or receptacles to make the invention usable in almost any household, institutional or commercial environment.

DESCRIPTION OF THE PREFERRED EMBODIMENT

Although the description that follows emphasizes the function of the present invention as a container for refuse it should be clearly understood that it is not restricted to the collection of refuse. The container invention could be used to store or collect a myriad of articles or material which need not fall into the general category of refuse.

Figure 1:
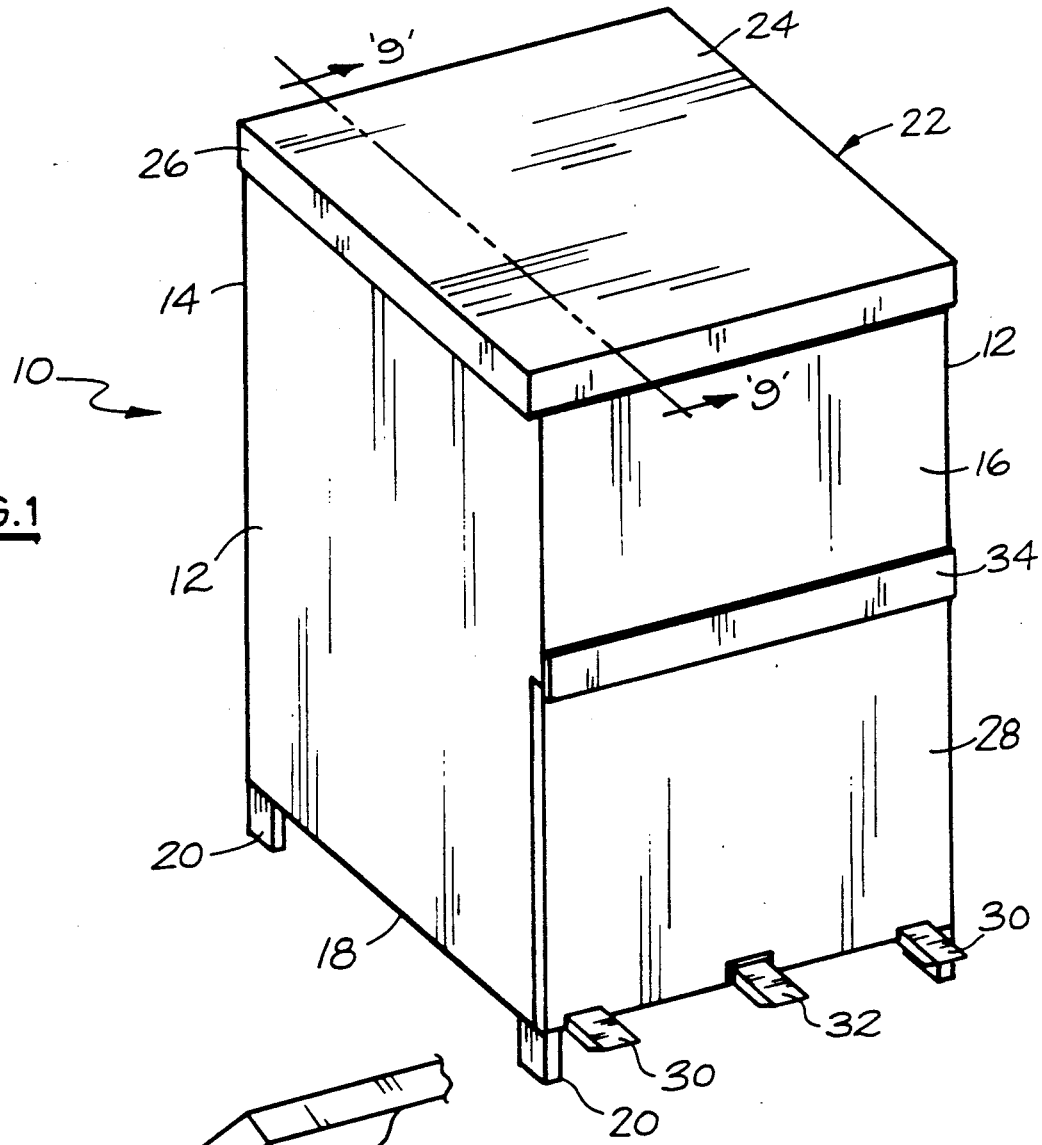
FIG. 1 shows a perspective view of the refuse container of this invention.

FIG. 1 shows a free-standing container or receptacle 10 in accordance with the present invention, as it might appear in a kitchen, laundry room or garage of a residential dwelling or as it might be used in institutions or industry. The container 10 has side walls 12,12 a rear wall 14, an upper front wall 16 and a bottom wall 18 those walls defining a generally parallelepiped housing. The housing is preferably supported by feet 20 although castors could be used if the container is to be rolled or moved frequently between various locations.

The container 10 is shown as having a top 22 defined by a flat upper wall 24 and a peripheral skirt defined by depending walls 26 which, when the top is in the closed position as shown, overly the upper edges of the container walls. The top 22 is pivoted to the housing in a manner to be described hereinafter so that it can be raised to provide access to the interior of the housing in a vertically downward direction. In the preferred embodiment a foot pedal 32 may be user-operated for remote manipulation of the top 22, as will be described later.

A lower front wall 28 closes a frontal opening below the upper front wall 16 and is pivotally attached to the bottom wall 18 along the front edge thereof so that it can be opened to provide access to the lower portion of the container. The preferred embodiment utilizes foot pedals 30 for pivoting the wall 28, in a manner to be described in greater detail hereinafter.

The front wall 28 also includes a transverse, flexible seal member 34 which overlies a gap "g", not seen in FIG. 1, between the adjacent transverse edges of the upper and lower walls 16,28 when the lower wall 28 is in its closed condition.

Figure 2:
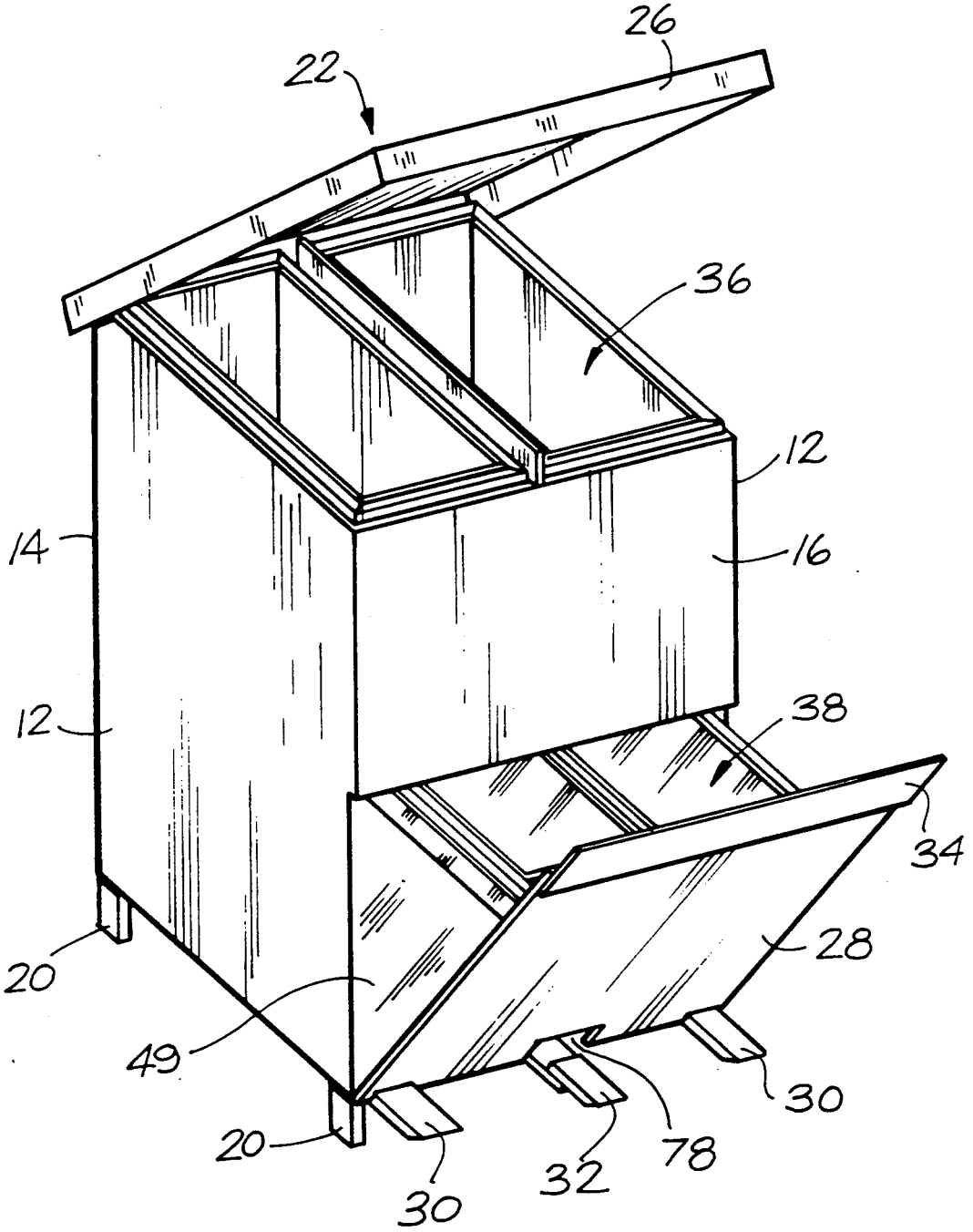
FIG. 2 shows the refuse container in an open condition.

FIG. 2 illustrates the interior refuse compartments which are accessible to the user when the top 22 and/or lower wall 28 is opened. It will be seen that raising the top 22 provides access to two vertically oriented open-topped compartments 36, each of which can receive refuse of a selected nature. Similarly, opening the bottom wall 28 provides access to two angled open-topped compartments 38 mounted on the inner surface of the lower wall 28, each being available to receive refuse of a selected nature. Of course, in its simplest version there would be but one compartment 36 and one compartment 38. Any combination of compartments 36,38 could be provided, the limitation in number being a function of the physical dimensions of the housing itself.

Figure 3:
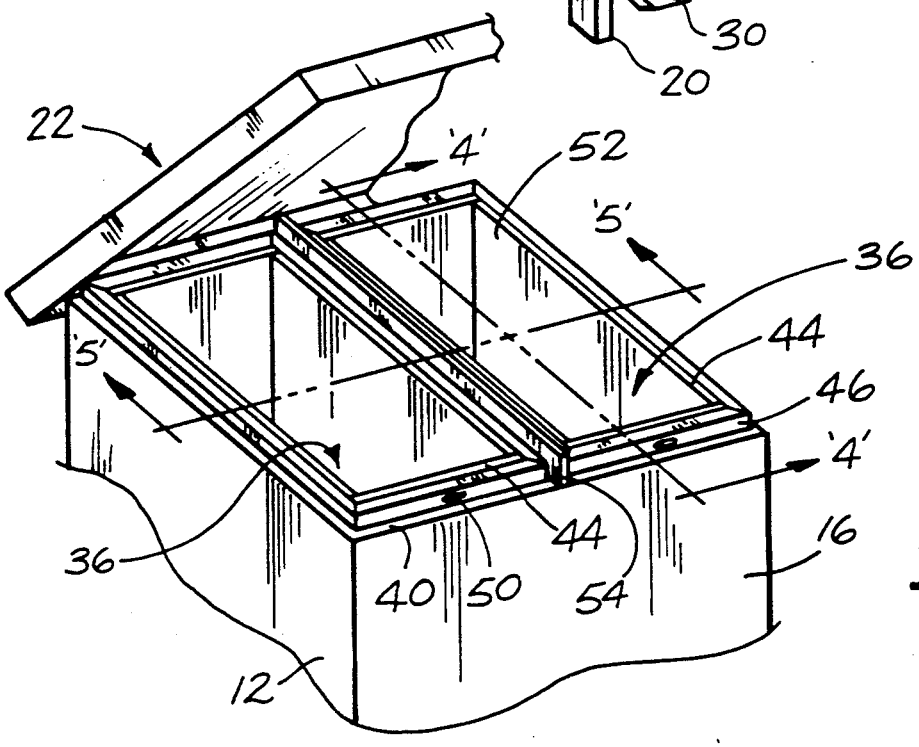
FIG. 3 shows a perspective view of the upper refuse compartments.
Figure 4:
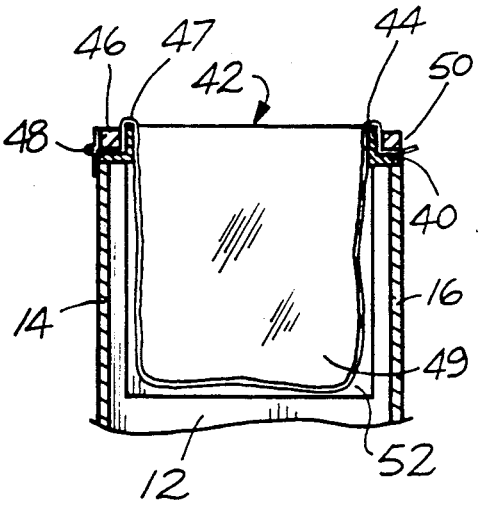

FIGS. 3 and 4 show the upper compartments 36 as they might be constructed for use with plastic shopping bags or plastic garbage bags. Therein it is seen that an upper wall 40 is provided at the top of the housing, the upper wall 40 having a pair of rectangular openings 42 defined by peripheral upstanding flanges 44. A frame member 46 is provided so as to contain the peripheral flange and to lay on the upper wall 40 outside of but adjacent to the flange 44. In use the flexible upper edge 47 of a plastic bag 49 is formed over the flange 44 therearound, with the bag depending therefrom to form the compartment 36. The frame member 46 is placed over the flange 44 in close fitting arrangement therewith so as to capture the bag sides therebetween and thus prevent the bag from falling into the housing under the weight of refuse therein.

With a wooden housing the upper wall 40 may be separately attached to the top portions of walls 12,12,14,16 as by wood screws. If the housing is made from plastic or metal then the top wall 40 and the flange 44 could be integrally molded or formed with the walls of the housing. Additionally, as seen in FIG. 4, the frame member 46 may be pivotally attached to the upper wall 40 as for example at the front thereof by hinges 48. If the frame member 46 is pivotally attached then a recess 50 could be cut into the front edge of the frame member to act as a finger-hold, making it easier for a user to pivotally raise the frame member when it is time to change refuse bags.

Figure 5:
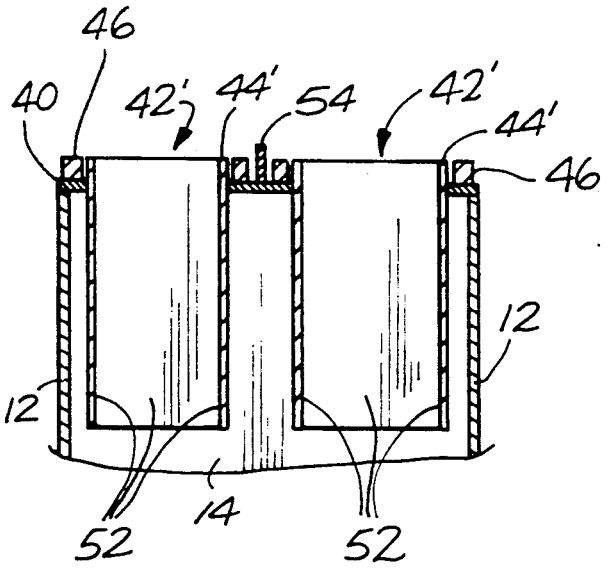
FIGS. 4 and 5 are sectional views taken on the lines 4—4 and 5—5 respectively of FIG. 3.

FIG. 5 shows a cross-sectional view at 90° to that shown in FIG. 4 and illustrates an alternative, and preferred construction for the refuse compartments. In this embodiment the top flange 44' includes panel portions 52 which extend downwardly into the housing. These panels separate one compartment from an adjacent compartment and also serve to facilitate the removal of a refuse-filled bag, since the bag sides are constrained by the panels 52. If the panels 52 were absent then the bag sides might expand laterally beyond the edges of the opening 42' defined by the flanges 44' as refuse is placed in the bag and there would be interference between the expanded bag sides and the edges of the opening 42' when the user attempts to remove the filled bag.

An upright divider wall 54 may be provided on the upper wall 40 between the adjacent refuse compartments 36 so that the edges of a bag inserted into one such compartment will not be trapped by the frame member 46 of the adjacent compartment.

Depending on the manner in which the housing is constructed it might be possible to have the portions of walls 12,14,16 adjacent a compartment 36 being in line, vertically, with the flange portions parallel thereto so that such wall portions would serve the same function as separate panels 52. Then it would be necessary to only provide a single such panel for each compartment, aligned with the flange portion extending from front to rear opposite the wall 12.

Figure 6:
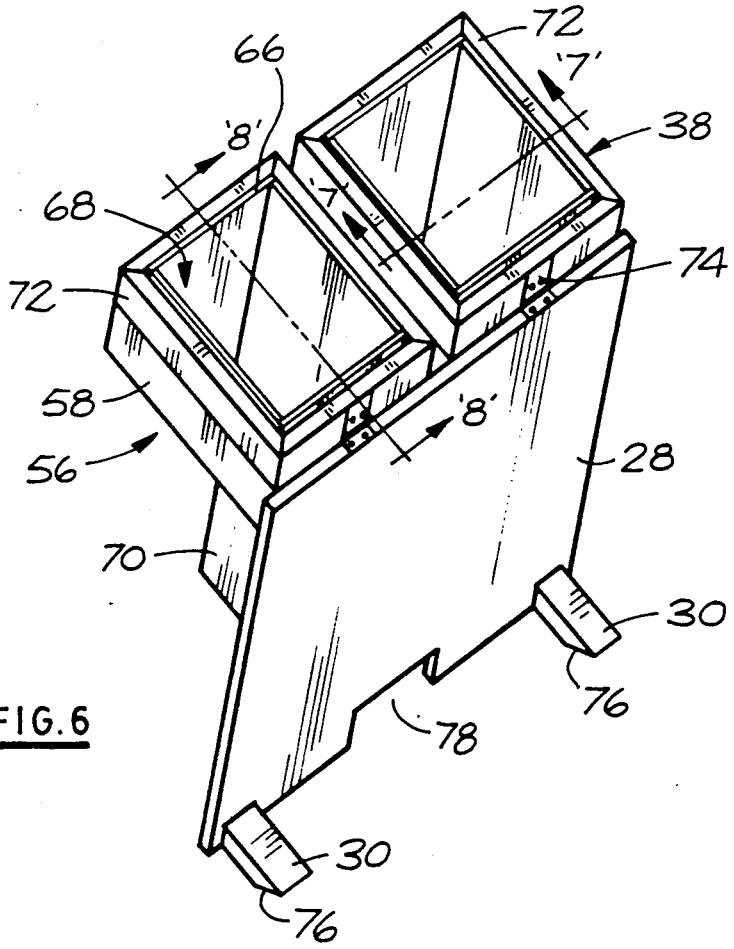
FIG. 6 shows a perspective view of the lower refuse compartments.
Figure 7:
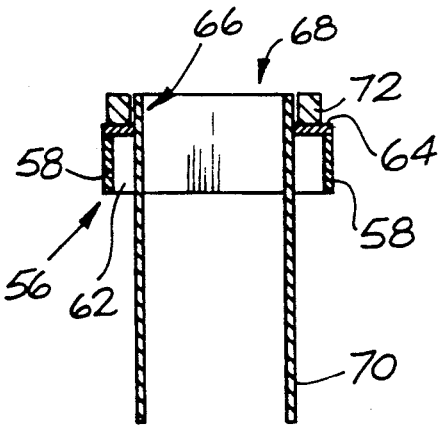
FIGS. 7 and 8 are sectional views taken on the lines 7—7 and 8—8 respectively of FIG. 6.
Figure 8:
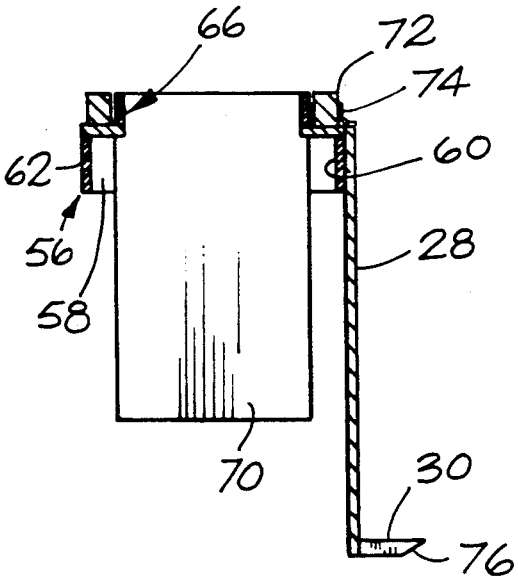

FIGS. 6, 7 and 8 show the lower front panel 28 with means attached thereto to define the second refuse-receiving compartments 38. In this case the compartments 38 are defined and constructed in a manner similar to the upper compartments 36. Thus, a frame 56 is constructed having peripheral side walls 58,60,62 and a top wall 64, the front wall 60 being secured to the inside surface of the pivotal lower wall 28 in any suitable and conventional manner such as by screws. An upwardly extending flange 66 defines a rectangular opening 68 into the compartment 38. As shown the front to rear portions of the flange 66 preferably extend downwardly from the top wall 64 as panels 70 to provide the same function as the panels 52 in the upper compartment 36. If desired, the transverse front and rear flange portions and the opposite side flange could also extend downwardly so as to provide a smooth-walled peripherally enclosed compartment having no edges or surfaces which would impede removal of a filled refuse bag. Also, although not shown, adjacent compartments could be separated by a divider wall similar to upper divider wall 54.

In order to capture a bag side wall on the flange 66 there is provided an open rectangular frame 72 which rests on the top wall 64 in close proximity to the flange 66. If desired, the frame 72 may be pivotally connected to the lower wall 28 as by the hinge 74.

Along the bottom edge of the lower wall 28 is seen a pair of foot pedals 30, each projecting forwardly from the front face of the wall 28. In order to avoid interference with the floor when the wall 28 is pivoted forwardly each foot pedal 30 may have a bevelled lower front edge 76. The lower edge of the wall 28 may have a rectangular cut-out 78 therein, the purpose of which will become apparent hereinbelow.

Remote operation of the top 22 will now be described with reference to FIGS. 9A, 9B, 10A, 10B, 11 and 12.

Figure 9A:
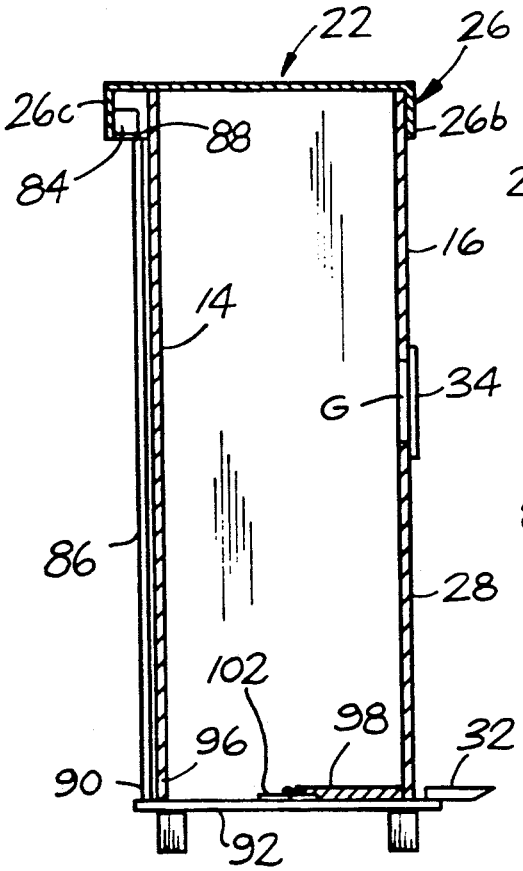
FIGS. 9A and 9B are vertical sections showing the means for opening the top.
Figure 9B:
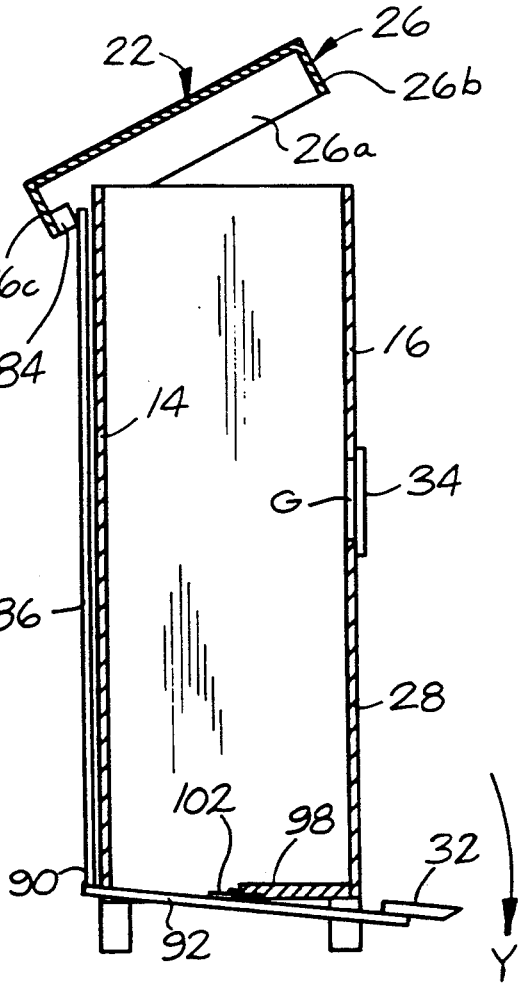
Figure 10A:
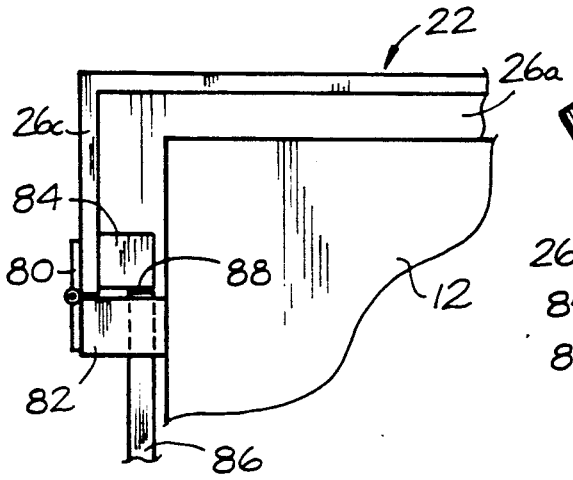
FIGS. 10A and 10B are partial sectional views showing the top opening means in greater detail.
Figure 10B:
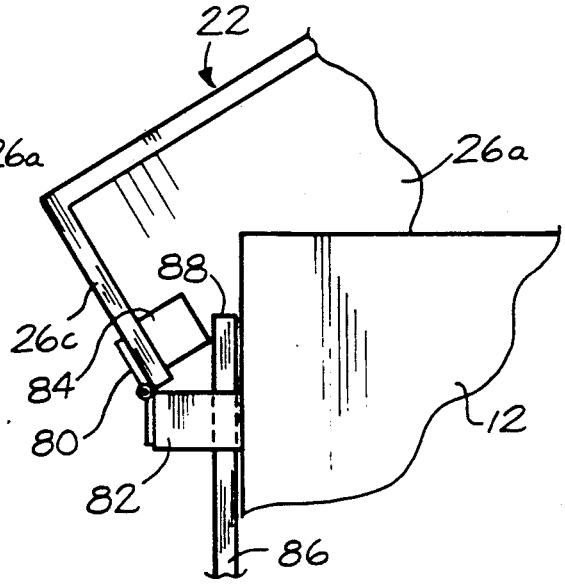
Figure 11:
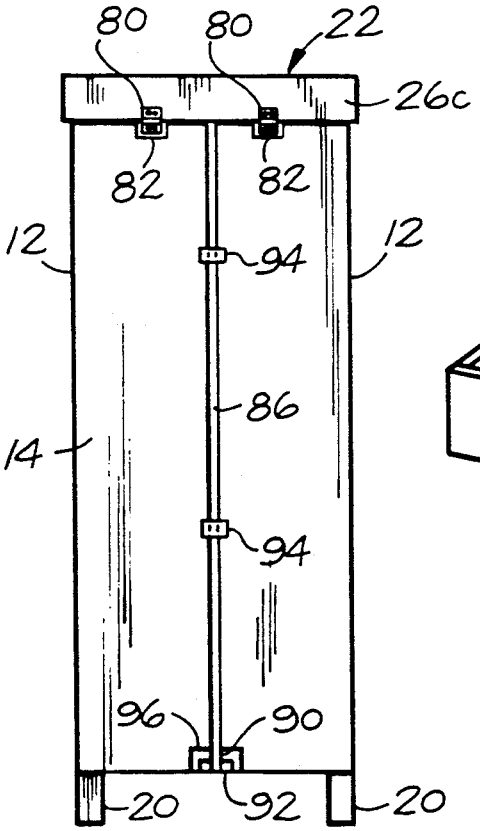
FIG. 11 is a rear view of the refuse container.

FIGS. 9A and 9B show a section along the line 9—9 of FIG. 1 but with the interior components of the housing absent for the sake of simplicity. Thus the back wall 14, one side wall 12 and the upper and lower walls 16,28 are shown along with the bottom wall 18 (see also FIG. 12). The top 22 is also shown with its peripheral skirt or side wall 26, including side portions **26*a*, front portion 26*b* and rear portion 26*c***.

As seen in FIGS. 9A, 9B, 10A and 10B the rear wall portion **26*c* of the top 22 is spaced rearwardly of the rear wall 14 so that it may be pivotally connected, as by hinges 80, to transversely spaced hinge blocks 82 mounted in a conventional manner to the rear wall 14. Between the hinge blocks 82 the inner surface of the top rear wall portion 26*c* mounts a rectangular lug 84 that extends towards the rear wall 14. The lug 84 is preferably located intermediate the ends of the rear wall portion 26*c***.

A cylindrical, square, or rectangular push rod 86 extends vertically along the rear wall 14 with its upper end 88 normally positioned just below the lug 84. The lower end 90 of the rod is pivotally attached to a lever arm 92 which extends from rear to front of the housing. Retaining loops or straps 94 keep the rod 86 in its vertical orientation.

With reference to FIGS. 9A, 9B, 11 and 12 it will be seen that the rear wall 14 has a central, bottom rectangular cut-out 96 therein and that the bottom wall 18 actually comprises transversely spaced apart wall portions **18*a*,18*b* joined by a support panel 98 which has its rear edge spaced forwardly from the rear wall 14. Lever arm 92 resides in the gap 100 between the bottom wall portions 18*a*,18*b* and is pivotally attached to panel 98 as by a hinge 102. The forward part of the lever arm 92 extends through cut-out 78 in lower front wall 28 and mounts the central foot pedal 32, also seen in FIG. 1, in front of the lower wall 28**.

By pressing down on foot pedal 32 (arrow Y, FIG. 9B) the rod 86 is pushed upwardly so that its upper end 88 will exert an upwardly directed force on the lug 84 thereby causing the top 22 to pivot upwardly and rearwardly (arrow Z). With a low pressure on pedal 32 the top 22 will be held open by the engagement between rod end 88 and lug 84 so that refuse may be placed in one or more of the upper compartments 36. If the pedal 32 is pushed fully downwardly then the push rod will be forced past the inner edge of the lug 84, opening the top 22 further (see FIG. 10B). Engagement of the lug 84 with the rod 86, effected by the weight of the top 22, will trap or pinch the rod in its vertically extended condition against the rear wall 14, the effect being to hold the top in an open, angled condition without requiring any holding pressure on the foot pedal 32. The user can then have more freedom of movement for filling the compartments 36 or for removing filled bags therefrom.

If the user pushes on the foot pedal 32 with a hard, fast force he will cause the top 22 to open quickly, perhaps so as to flip past 90°, thereby completely opening the upper part of the housing. To close the top 22 the user would have to pull the top forwardly and downwardly by hand.

The foregoing has described the preferred embodiment of the refuse container of this invention. The way in which it can be best utilized will now be described.

The refuse container 10 was designed to make use primarily of plastic shopping bags obtained from grocery stores in the course of normal shopping. It can also be used with commercially available kitchen-style refuse bags such as GLAD KITCHEN CATCHERS (trade-mark). The user will initially open the top 22 as hereinbefore described and place a bag in each compartment 36, trapping the bag edges on the flange 44 or 44' with the frame 46 as previously described. He then tilts the lower wall 28 forwardly to expose the lower compartments 38 and he places a bag in each such compartment, trapping the bag edges on the flange 66 by the frame 72.

When refuse is to be placed in the container 10 the user will open the top 22 and/or the lower wall 28 so as to obtain access to the refuse bag that he has selected to receive the refuse to be deposited therein. One bag may receive food refuse suitable for composting; another may receive the remaining food waste; yet another may receive recyclable metallic waste; still another may receive recyclable glass items. As each bag is filled it may be removed from the container 10 for collection, composting or whatever and a new bag placed in the vacant compartment. Thus the user of this invention has a device which is designed to utilize plastic grocery bags, is sanitary, and allows him to separate his refuse into various subclasses for appropriate later deposition.

While the preferred embodiment incorporates the features just described it is clear that several variations could be effected to simplify the structure or to render it even more versatile.

Figure 13:
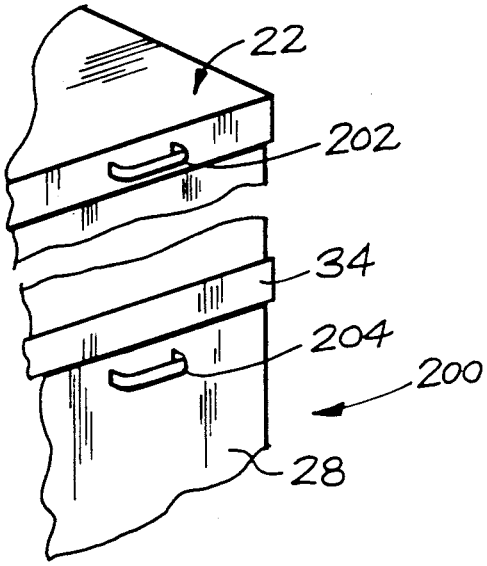
FIG. 13 shows a simplified version of the refuse container.

An example of a simplified container 200 is shown in FIG. 13. Therein it is seen that the foot pedals 30,32 are not provided. Similarly the lever arm and rod mechanism used to open the top are not provided. In their place the top is provided with a handle 202 on the front face thereof and the lower front wall is provided with a handle 204 just below the seal strip 34. The handles are used to move the top 22 or the front wall 28 to gain access to the refuse compartments but, unlike the preferred embodiment such access will not be "hands-free" since one hand will be required to open and to hold open the top or lower front wall.

Figure 14:
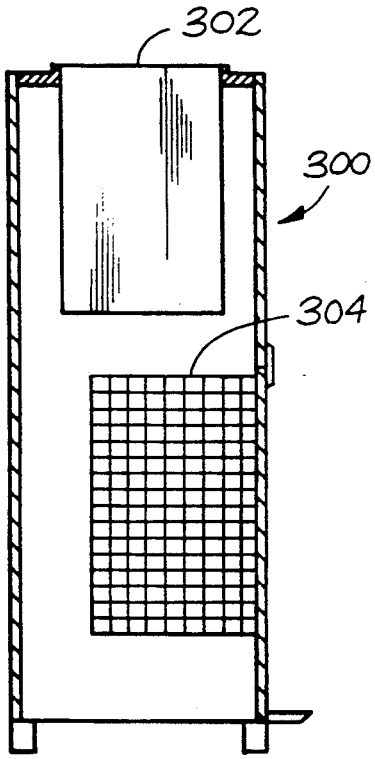
FIG. 14 shows, in partial section, the use of baskets in place of flexible bags.
Figure 15:
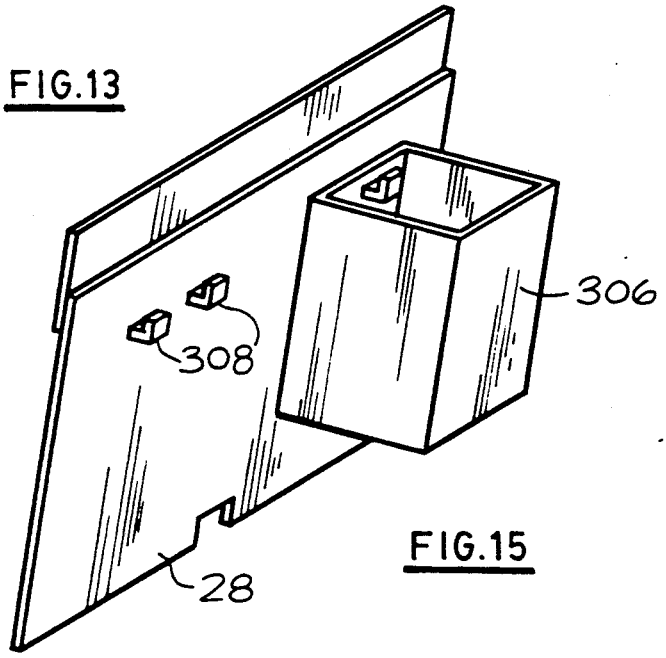
FIG. 15 shows one way of hanging baskets for the lower compartments.

Another embodiment is shown in partial simplified section in FIG. 14 wherein the container 300 is shown as having removable bins or baskets 302,304 in place of the flexible bags 49. In this case the baskets may have solid walls (see basket 302); they could have mesh walls (see basket 304); they could have a honeycomb construction; or they could have solid walls with weight reducing holes therethrough. These baskets would likely be used to collect recyclable solid material such as metal cans or glass bottles, etcetera. Preferably the baskets could be lifted from the container 300 once filled. Alternatively, each basket could receive a plastic or paper shopping bag as a liner, the bag being removable for subsequent disposal. As a further alternative the baskets 306 as shown in FIG. 15 could have holes adjacent the upper edge for engagement with hooks 308 provided on the inner surface of the lower front wall 28. Such baskets would be easily unhooked from the hooks 308 for appropriate disposition of the refuse contained therein.

If the seal strip 34 is sufficiently flexible, is made up of a curtain of flexible strips, is spring mounted to the lower front wall 28, or is removable therefrom, the refuse could be inserted directly into a compartment 38 through the gap "g" without opening the lower front wall 28. This feature would probably be used only for solid refuse such as cans or glass items.

Figure 16:
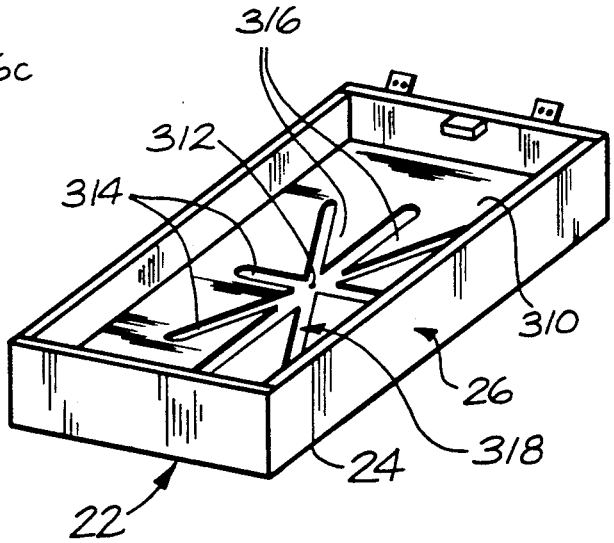
FIG. 16 shows a storage compartment for flexible bags.
Figure 12:
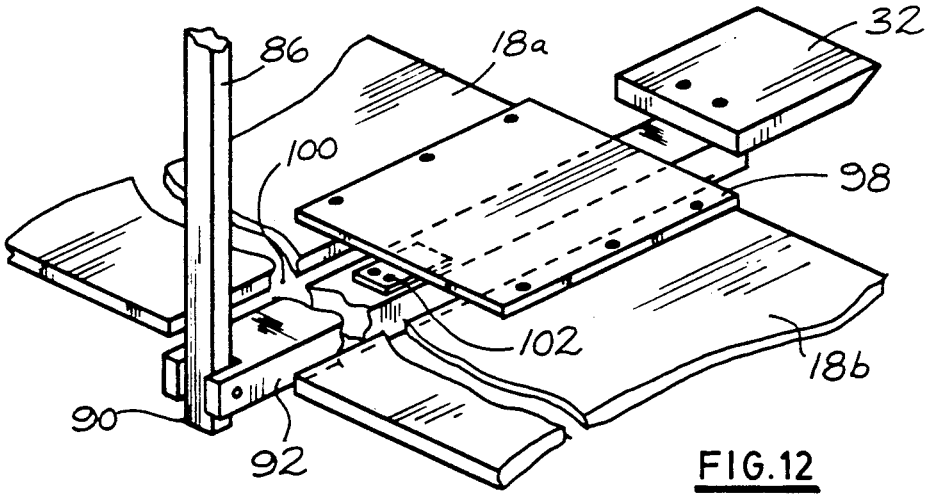
FIG. 12 is a view of the bottom of the container.

Another alternative is shown in FIG. 16 wherein the top 22 is provided with an internal compartment for the storage of plastic bags. This compartment is defined by the top and side walls of the top 22 and a wall 310 of flexible sheet material spaced downwardly from the top wall 24 and secured to the peripheral side wall 26. The internal wall 310 is provided with an access opening 312 defined by intersecting slots 314 which in turn create flexible petals 316. Once can push plastic bags into the compartment 318 past the petals 316 and, when a new bag is required, one can reach into the compartment 318 through the opening 312, grasp a bag and pull it through the opening 312 past the petals 316 for further use.

Figure 17:
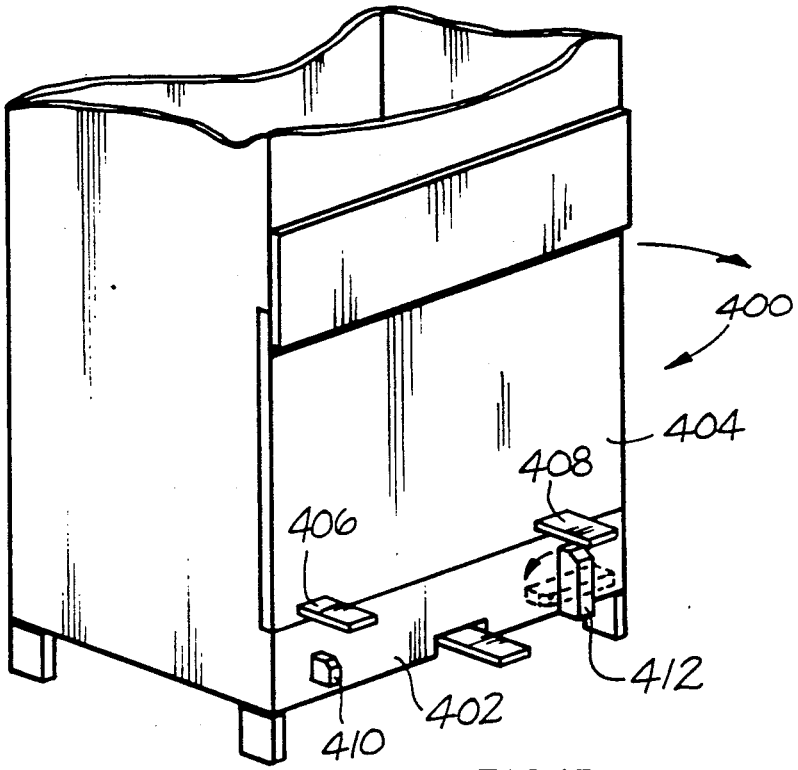
FIG. 17 shows an alternative arrangement for opening the lower front wall.

FIG. 17 shows a container 400 wherein there is a kick plate 402 along the bottom front edge with the lower front wall 404 being hinged thereto. Pedal 406,408 are attached to the wall 404 adjacent the bottom edge thereof.

A first block 410 is secured to the kick plate below the pedal 406 so that when the lower front wall 404 is fully opened to completely expose the compartments supported thereby the pedal 406 will rest against the block 410 and hold the lower front wall in its open position. In this position the mechanism holding bags in place can be operated without encountering interference with the rest of the container 400. Similarly, if bins or baskets are used in place of bags such bins or baskets can be readily removed with the lower front wall in this fully open position.

A second block 412 is located on the kick plate below the pedal 408. This block is longer than the block 410 and is rotatably mounted on the kick plate. When it is in its upright orientation as shown in solid lines the lower front wall 404 can be opened to about 80% or 85% of its full travel so that it is convenient to place refuse in the appropriate bag, bin or basket. The block 412 can be rotated by hand or foot to the orientation shown in dotted lines so that the lower front wall can be opened further, to the limit position defined by the block 410. The two-block limit defining means as described makes it easier to return the lower front wall 404 to its closed condition under normal operating conditions when the open position is defined by the block 412 in its upright position.

Figure 18:
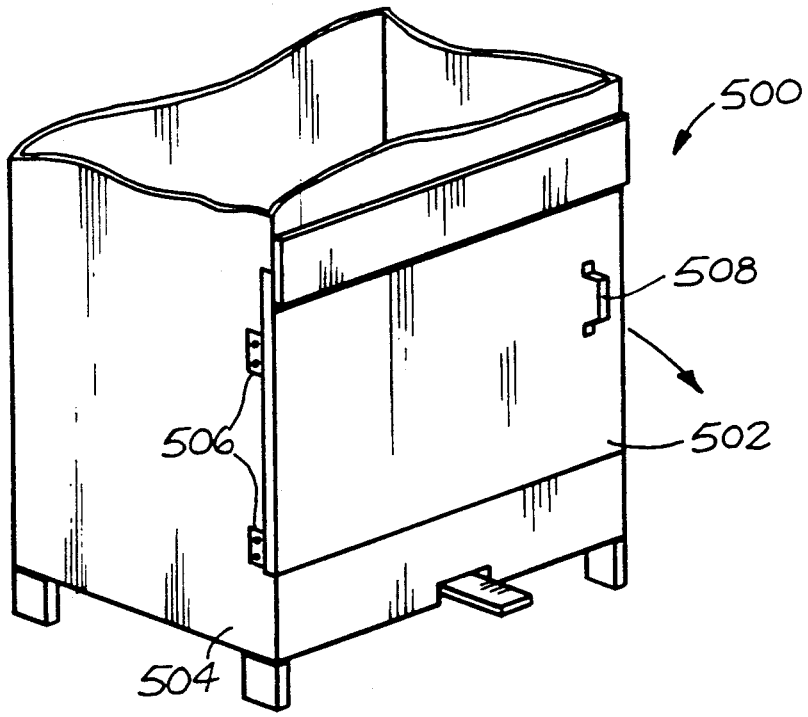
FIG. 18 shows a container having a side opening lower wall.

Yet another variation is seen in FIG. 18 wherein the container 500 has a lower front wall 502 that is hinged to a side wall 504 via hinges 506 for lateral swinging motion to expose the compartment(s) supported thereby. With such a construction the gap "g" would not need to be as great as with a bottom hinged wall since there would be no interference between the compartments and the upper front wall of the container. Of course the lower front wall could be built as two oppositely opening doors, hinged to opposite side walls, with each such door supporting an appropriate compartment defining means. A handle 508 would be provided for controlling opening and closing movements.

The foregoing has described the preferred embodiment and several alternative configurations for my invention. It is understood that a skilled workman would be able to further alter the invention to suit particular circumstances without departing from the spirit thereof and accordingly the protection to be afforded this invention is to be determined from the claims appended hereto.

The embodiments of the invention in which an exclusive property or privilege is claimed are defined as follows:

1. A multi-compartmented refuse container comprising:

a) a housing defined by a bottom wall and upright rear, side and upper front walls;

b) foot means spacing said bottom wall above a ground plane;

c) a lower front wall hingedly attached to said bottom wall along a forward edge thereof and sized to close a lower opening in said housing below said upper front wall;

d) a top wall sized to close said housing at the top thereof, said top wall including a depending skirt having front, side and rear wall portions;

e) hinge means connecting said skirt rear wall portion to said housing rear wall permitting pivoting motion of said top wall between a closed position and an open condition;

f) a plurality of first clamping flange and clamping frame pairs at the top of said housing, each pair being adapted to releasably support a flexible bag so as to provide an upwardly opening independent first refuse compartment;

g) a plurality of second clamping flange and clamping frame pairs attached to said lower front wall adjacent an upper edge thereof, each pair being adapted to releasably support a flexible bag so as to provide an independent generally upwardly opening second refuse compartment;

h) a first foot pedal extending forwardly of said container at the bottom thereof, said first foot pedal being attached to a lever arm pivotally connected intermediate its ends to and below said bottom wall and extending to beyond said rear wall;

i) a rod extending upwardly adjacent said rear wall and adapted to transmit pivoting movement of said lever arm to said top wall; and j) at least one second foot pedal extending forwardly from said lower front wall adjacent a bottom edge thereof, operation thereof serving to pivot said lower wall from a closed position to an open condition.

2. A multi-compartmented container comprising:

a) a housing defined by side, rear, bottom and upper front walls;

b) a lower front wall pivotally attached to one of a side wall or said bottom wall;

c) a top wall including a depending peripheral skirt having front, side and rear wall portions, said rear wall portion being spaced from and pivotally attached to said housing rear wall;

d) first means defining at least one first compartment in an upper portion of said container;

e) second means defining at least one second compartment connected to said lower front wall;

f) first pivot means operable by a user to open said top wall so as to provide access to said at least one first compartment, said first pivot means including a lever arm pivotally connected intermediate its ends to and below said bottom wall, said lever arm extending to a foot pedal in front of said housing, a rod extending upwardly adjacent said rear wall with a lower end of said rod contacting said lever arm, and a lug attached to said skirt rear wall portion and of such a length that initial upward movement of said rod will bring its upper end into force applying contact with said lug to pivot said top wall upwardly to its open condition, and continued upward movement of said rod will move its upper end past the inner end of said lug whereby the lug inner end can bear against said rod to prevent said top wall from returning to its closed condition; and g) second pivot means operable by a user to pivot said lower front wall forwardly so as to provide access to said at least one second compartment.

3. A multi-compartment refuse container comprising:

a) a housing defined by a bottom wall and upright rear, side and upper front walls;

b) a lower front wall pivotally attached to said bottom wall along a forward edge thereof and sized to close a lower opening in said housing below said upper front wall;

c) a top wall including a depending peripheral skirt having front, side and rear wall portions, said rear wall portion being spaced from and pivotally attached to said housing rear wall;

d) first means delineating a plurality of upwardly opening first refuse compartments in an upper portion of said housing;

e) second means delineating a plurality of upwardly opening second refuse compartments connected to said lower front wall for containment in a lower portion of said housing;

f) first pivot means operable by a user's foot to pivot said top wall from a closed position to an open condition so as to provide access to said first refuse compartments, said first pivot means including a lever arm pivotally connected intermediate its ends to and below said bottom wall, said lever arm extending to a foot pedal in front of said housing, a rod extending upwardly adjacent said rear wall with a lower end of said rod contacting said lever arm, and a lug attached to said skirt rear wall portion and of such a length that initial upward movement of said rod will bring its upper end into force applying contact with said lug to pivot said top wall upwardly to its open condition, and continued upward movement of said rod will move its upper end past the inner end of said lug whereby the inner end of said lug can bear against said rod to prevent said top wall from returning to its closed position; and g) second pivot means operable by a user's foot to pivot said lower front wall forwardly from a closed position to an open condition so as to provide access to said second refuse compartments.

4. A multi-compartmented container comprising:

a) a housing defined by side, rear, bottom and upper front walls, said bottom wall being spaced upwardly above a ground plane;

b) a lower front wall pivotally attached to said bottom wall;

c) a top wall including a depending skirt having front, rear and side portions, said rear skirt portion being spaced from said housing rear wall and mounting a lug which extends towards said housing rear wall;

d) at least one mounting block secured to said housing rear wall adjacent a top edge thereof and hinge means attached to said block and said rear skirt portion;

e) first means defining at least one first compartment in an upper portion of said container;

f) second means defining at least one second compartment connected to said lower front wall;

g) first pivot means operable by a user to open said top wall so as to provide access to said at least one first compartment, said first pivot means including a lever arm pivotally connected intermediate its ends to and below said bottom wall, said lever arm extending from behind said rear wall to a foot pedal in front of said housing; and a rod extending upwardly adjacent said rear wall, a lower end of said rod contacting said lever arm; downward pressure on said foot pedal causing said rod to move upwardly, bringing its upper end into force applying contact with said lug to pivot said top wall upwardly on said hinge means to an open condition, and continued upward movement of said rod moving it past the inner end of said lug whereby the lug inner end can bear against said rod to prevent said top wall from returning to its closed condition; and h) independently operable second pivot means comprising at least one foot pedal extending forwardly from said lower front wall adjacent a bottom edge thereof whereby downward pressure on said last-mentioned foot pedal will cause said lower front wall to pivot forwardly.

5. The container of claim 4 wherein each of said first and second compartment defining means comprises means for releasably clamping a side wall of a flexible bag such that may be deposited within the clamped bag.

6. The container according to claim 2 wherein each of said clamping means comprises: a top wall extending around the compartment; an upright flange extending around an opening to the compartment and a clamping frame pivotally connected to said clamping means top wall and sized to surround said flange; whereby the side wall of a bag can be formed over said flange, with the bag depending therefrom, and said clamping frame can be pivoted into clamping engagement with said flange to clamp said bag side wall therebetween.

7. The container of claim 4 wherein each of said compartments is an independent appropriately sized basket separately removable from said housing.

8. The container of claim 4 including bag storage means contained within said top wall.

9. A multi-compartmented container comprising:

a) a housing defined by side, rear, bottom and upper front walls;

b) a lower front wall pivotally attached to one of a side wall or said bottom wall.

c) a top wall pivotally attached to said rear wall, said top wall including peripheral side walls depending therefrom;

d) bag storage means contained in said top wall, said storage means including a storage compartment defined by said top wall, said peripheral side walls, and a sheet of flexible material spaced from said top wall and connected to said peripheral side walls, access to said storage compartment being through an opening defined by intersecting slots in said sheet of flexible material;

e) first means defining at least one first compartment in an upper portion of said container;

f) second means defining at least one second compartment connected to said lower front wall;

g) first pivot means operable by a user to open said top wall so as to provide access to said at least one first compartment; and h) second pivot means operable by a user to pivot said lower front wall forwardly so as to provide access to said at least one second compartment.

10. The refuse container of claim 9 wherein each of said first and second refuse compartment delineating means comprises means for releasably clamping a side wall of a flexible bag such that refuse may be deposited within the clamped bag.

11. The refuse container according to claim 10 wherein each of said clamping means comprises: a top wall extending around the refuse compartment; an upright flange extending around an opening to the compartment and a clamping frame pivotally connected to said clamping means top wall and sized to surround said flange; whereby the side wall of a bag can be formed over said flange, with the bag depending therefrom, and said clamping frame can be pivoted into clamping engagement with said flange to clamp said bag side wall therebetween.

12. The refuse container of claim 9 wherein each of said refuse compartments is an independent appropriately sized basket separately removable from said housing.

13. The refuse container of claim 9 including bag storage means contained within said top wall.

14. A multi-compartmented refuse container comprising:

a) a housing defined by a bottom wall spaced upwardly above a ground plane and upright rear, side and upper front walls;

b) a lower front wall pivotally attached to said bottom wall along a forward edge thereof and sized to close a lower opening in said housing below said upper front wall;

c) a top wall including a depending peripheral skirt having front, rear and side portions, said rear skirt portion being spaced from said housing rear wall and mounting a lug which extends towards said housing rear wall;

d) at least one mounting block secured to said housing rear wall adjacent a top edge thereof and hinge means attached to said block and said rear skirt portion;

e) first means delineating a plurality of upwardly opening first refuse compartments in an upper portion of said housing;

f) second means delineating a plurality of upwardly opening second refuse compartments connected to said lower front wall for containment in a lower portion of said housing;

g) first pivot means operable by a user's foot to pivot said top wall from a closed position to an open condition so as to provide access to said first refuse compartments, said first pivot means including a lever arm pivotally connected intermediate its ends to and below said bottom wall, said lever arm extending from behind said rear wall to a foot pedal in front of said lower front wall; and a rod extending upwardly adjacent said rear wall with a lower end of said rod contacting said lever arm; downward pressure on said foot pedal causing said rod to move upwardly, bringing its upper end into force applying contact with said lug to pivot said top wall upwardly on said hinge means to its open condition, and continued upwardly movement of said rod moving it past the inner end of said lug whereby the lug inner end can bear against said rod to prevent said top wall from returning to its closed position; and h) independent second pivot means operable by a user's foot to pivot said lower front wall forwardly from a closed position to an open condition so as to provide access to said second refuse compartments, said second pivot means including at least one foot pedal extending forwardly from said lower front wall adjacent a bottom edge thereof.

* * * * *